US010934766B2

(12) United States Patent
Gouge et al.

(10) Patent No.: US 10,934,766 B2
(45) **Date of Patent: *Mar. 2, 2021**

(54) DOOR WITH FRAMELESS GLAZED UNIT, AND RELATED KIT AND METHODS

(71) Applicant: Masonite Corporation, Tampa, FL (US)

(72) Inventors: Timothy D. Gouge, Elgin, IL (US); Abhishek Vaidya, Schaumburg, IL (US); Robert C. Allen, Elburn, IL (US); Steven B. Swartzmiller, Batavia, IL (US); Jason M. Walsh, Batavia, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/872,499

(22) Filed: May 12, 2020

(65) Prior Publication Data

US 2020/0270933 A1 Aug. 27, 2020

Related U.S. Application Data

(63) Continuation of application No. 16/279,082, filed on Feb. 19, 2019, now Pat. No. 10,648,222, which is a (Continued)

(51) Int. Cl.
*E04B 2/54* (2006.01)
*E06B 3/54* (2006.01)
(Continued)

(52) U.S. Cl.
CPC ..... *E06B 3/5418* (2013.01); *E06B 3/06* (2013.01); *E06B 3/54* (2013.01); *E06B 3/56* (2013.01);
(Continued)

(58) Field of Classification Search
CPC ..... E06B 2003/7049; E06B 3/06; E06B 3/54; E06B 3/70; E06B 3/72
(Continued)

(56) References Cited

U.S. PATENT DOCUMENTS 4,720,951 A 1/1988 Thorn et al.
6,068,802 A * 5/2000 Berghorn ..... B29C 44/1233 156/78
(Continued)

FOREIGN PATENT DOCUMENTS

DE 19819399 C1 10/1999
JP 2010084414 A 4/2010
WO WO2004106689 A2 12/2004

*Primary Examiner* — Brian E Glessner
*Assistant Examiner* — James J Buckle, Jr.
(74) *Attorney, Agent, or Firm* — Berenato & White, LLC

(57) ABSTRACT

A door includes a door frame, first and second door skins having rectangular outer peripheries and inner openings, and a frameless glazed unit received at the openings. The door skins include exterior surfaces facing away from the door frame and opposite interior surfaces facing and secured to opposite sides of the door frame. The exterior and interior surfaces of the first and second door skins establish integral lips and grooves of the first and second door skins. Opposite sides of the frameless glazed unit directly contact and are sealed by the integral lips and sealant and/or adhesive contained in the grooves of the first and second door skins.

20 Claims, 4 Drawing Sheets

Related U.S. Application Data continuation of application No. 16/018,764, filed on Jun. 26, 2018, now Pat. No. 10,208,530, which is a continuation of application No. 15/489,886, filed on Apr. 18, 2017, now Pat. No. 10,006,240, which is a continuation of application No. 15/284,927, filed on Oct. 4, 2016, now Pat. No. 9,624,714, which is a continuation of application No. 14/796,146, filed on Jul. 10, 2015, now Pat. No. 9,458,660.

(60) Provisional application No. 62/023,284, filed on Jul. 11, 2014.

(51) Int. Cl.

| | |
|---|---|
| ***E06B 3/58*** | (2006.01) |
| ***E06B 3/82*** | (2006.01) |
| ***E06B 3/06*** | (2006.01) |
| ***E06B 3/70*** | (2006.01) |
| ***E06B 3/72*** | (2006.01) |
| ***E06B 3/66*** | (2006.01) |
| ***E06B 3/86*** | (2006.01) |
| ***E06B 3/56*** | (2006.01) |
| ***E06B 3/67*** | (2006.01) |

(52) U.S. Cl.

CPC ..... *E06B 3/5892* (2013.01); *E06B 3/6621* (2013.01); *E06B 3/67* (2013.01); *E06B 3/70* (2013.01); *E06B 3/72* (2013.01); *E06B 3/822* (2013.01); *E06B 3/86* (2013.01); *E06B 2003/7049* (2013.01)

(58) Field of Classification Search

USPC ..... 52/204.64, 455, 456, 457, 458, 784

See application file for complete search history.

(56) References Cited

U.S. PATENT DOCUMENTS

| | | | | |
|---|---|---|---|---|
| 6,729,095 | B2 * | 5/2004 | Wang Chen | E06B 3/5892 49/501 |
| 6,786,021 | B1 | 9/2004 | Chen | |
| 7,721,501 | B2 * | 5/2010 | Lynch | E06B 3/78 52/456 |
| 7,950,193 | B1 | 5/2011 | Plummer | |
| 9,458,660 | B2 | 10/2016 | Gouge et al. | |
| 9,624,714 | B2 | 4/2017 | Gouge et al. | |
| 10,006,240 | B2 | 6/2018 | Gouge et al. | |
| 10,208,530 | B2 | 2/2019 | Gouge et al. | |
| 10,648,222 | B2 | 5/2020 | Gouge et al. | |
| 2002/0092254 | A1 | 7/2002 | Wang Chen | |
| 2006/0080924 | A1 | 4/2006 | Sibbett | |
| 2008/0209826 | A1 * | 9/2008 | Hodges | E06B 3/5892 52/204.7 |
| 2008/0245003 | A1 | 10/2008 | Kon et al. | |
| 2010/0300003 | A1 | 12/2010 | Goode | |
| 2017/0247934 | A1 * | 8/2017 | Cai | E06B 3/5892 |
| 2019/0055774 | A1 * | 2/2019 | Wang | E06B 3/549 |

* cited by examiner

DOOR WITH FRAMELESS GLAZED UNIT, AND RELATED KIT AND METHODS

CLAIM OF PRIORITY AND CROSS-REFERENCE TO RELATED APPLICATION(S)

This application is a continuation of U.S. patent application Ser. No. 16/279,082, filed Feb. 19, 2019, now U.S. Pat. No. 10,648,222, which is a continuation of U.S. patent application Ser. No. 16/018,764, filed Jun. 26, 2018, now U.S. Pat. No. 10,208,530, which is a continuation of U.S. patent application Ser. No. 15/489,886, filed Apr. 18, 2017, now U.S. Pat. No. 10,006,240, which is a continuation of U.S. patent application Ser. No. 15/284,927, filed Oct. 4, 2016, now U.S. Pat. No. 9,624,714, which is a continuation of U.S. patent application Ser. No. 14/796,146, filed Jul. 10, 2015, now U.S. Pat. No. 9,458,660, which claims the benefit of priority of U.S. Provisional Application No. 62/023,284 filed on Jul. 11, 2014, the complete disclosures of which are incorporated herein by reference.

FIELD OF THE INVENTION

The present invention relates to doors in general and, more particularly, to doors having one or more glazed units, and related kits and methods.

BACKGROUND

Fiberglass doors are common substitutes for traditional wooden doors in residential and commercial buildings. Fiberglass doors include door skins (also known in the art as door facings) secured to opposite sides of a rectangular door frame. A resulting cavity between the door skins and surrounded by the door frame optionally is filled with a core material, such as an expanded polymer foam. Doors so constructed can have wood graining printed, molded, or otherwise applied on the exterior surfaces of the door skins, and also raised paneling formed (e.g., molded) in the door skins. These features give the doors the appearance of natural wood fabricated products. Optionally, paint, stain, lacquer, and/or a protective layer may be applied to the exterior surface.

Fiberglass doors are a type of sythetic door. Fiberglass door skins are sometimes formed of sheet molding compound (or SMC) sheets containing resinous sheets reinforced with fiberglass, often chopped fiberglass or fiberglass mats. The sheet molding compound is deposited in a compression molding machine and subjected to high pressures and elevated temperatures to cure the resinous material and form the resulting door skins, which then are removed from the compression molding machine as a structurally stable, consolidated articles that may be secured to door frames.

Fiberglass doors sometimes include glazed units, also known as glazings, glass inserts, lights, or lites. A full size glazed unit may constitute a majority, even 60 percent or more, of the exterior surface area of a door. Other glazed units may be smaller. A window frame, typically made of plastic or a metal such as aluminum, surrounds the glazed unit and connects the door skins to the glazed unit. An example of a fiberglass door with a window frame connecting door skins to a transluscent window is shown in U.S. Pat. Pub. No. 2008/0245003. As best shown in FIG. 3 of the published application, the window frame includes frame members 30, 50 surrounding the window. The frame members 30, 50 include bulbous door receiving portions 31, 51 and panel support portions 32, 52 with convex exterior surfaces extending outwardly from the planar areas of the door skins. Because of the bulbuous portions, stacking of multiple doors or door skins on one another for transport or storage is difficult and the stacks may be unstable because the bulbuous portions decrease surface contact area between stacked doors or door skins. Sliding and rocking of stacked doors/door skins can result in damage, such as paint picking, burnishing, and cracking to the exterior surfaces of the door skins.

SUMMARY OF THE INVENTION

According to a first aspect of the invention, a door is provided that includes at least a door frame having a first side and a second side, a first door skin having a first rectangular outer periphery and a first inner opening, a second door skin having a second rectangular outer periphery and a second inner opening, and a frameless glazed unit received at the first and second inner openings. The first door skin includes a first exterior surface facing away from the door frame and an opposite first interior surface facing and secured to the first side of the door frame, the first exterior surface and the first interior surface collectively establishing a first lip that is integral with the first door skin and is situated at the first inner opening. The first interior surface provides a first groove containing a first sealant and/or adhesive. The second door skin includes a second exterior surface facing away from the door frame and an opposite second interior surface facing and secured to the second side of the door frame. The second exterior surface and the second interior surface collectively establish a second lip that is integral with the second door skin and is situated at the second inner opening. The second interior surface provides a second groove containing a second sealant and/or adhesive that may be identical to or different than the first sealant and/or adhesive. The frameless glazed unit includes opposite first and second sides. The first side of the frameless glazed unit directly contacts and is sealed to the first door skin by the integral first lip and the first sealant and/or adhesive. The second side of the frameless glazed unit directly contacts and is sealed to the second door skin by the integral second lip and the second sealant and/or adhesive.

A second aspect of the invention provides a kit for making a door. The kit features at least a door frame having a first side and a second side, a first door skin having a first rectangular outer periphery and a first inner opening, a second door skin having a second rectangular outer periphery and a second inner opening, and a frameless glazed unit configured to be received at the first and second inner openings. The first door skin includes a first exterior surface configured to face away from the door frame and an opposite first interior surface configured to face toward and be secured to the first side of the door frame. The first exterior surface and the first interior surface collectively establish a first lip that is integral with the first door skin and is situated at the first inner opening. The first interior surface provides a first groove configured to receive a first sealant and/or adhesive. The second door skin includes a second exterior surface configured to face away from the door frame and an opposite second interior surface configured to face toward and be secured to the second side of the door frame. The second exterior surface and the second interior surface collectively establish a second lip that is integral with the second door skin and is situated at the second inner opening. The second interior surface provides a second groove configured to receive a second sealant and/or adhesive which may be the same as or different than the first sealant and/or adhesive. The frameless glazed unit includes opposite first and second sides configured to directly contact and be sealed to the first and second door skins by the integral first lip and the first sealant and/or adhesive of the first door skin and the integral second lip and the second sealant and/or adhesive of the second door skin, respectively.

A third aspect of the invention provides a method of making a door. According to this method, a first door skin is connected to a first side of a door frame. The first door skin has a first rectangular outer periphery and a first inner opening and includes a first exterior surface facing away from the door frame and an opposite first interior surface facing and connected to the first side of the door frame. The first exterior surface and the first interior surface collectively establish a first lip that is integral with the first door skin and is situated at the first inner opening. A first sealant and/or adhesive is applied to a first groove in the first interior surface. A frameless glazed unit is situated at the first inner opening to contact a first side of the frameless glazed unit with the first lip and the first sealant and/or adhesive. A second door skin having a second rectangular outer periphery and a second inner opening is provided. The second door skin includes a second exterior surface and an opposite second interior surface collectively establishing a second lip that is integral with the second door skin. A second sealant and/or adhesive, which may be the same as or different than the first sealant and/or adhesive, is applied to a second groove in the second interior surface. The second interior surface of the second door skin is connected to a second side of the door frame to situate the frameless glazed unit at the second inner opening and contact a second side of the frameless glazed unit with the second lip and the second sealant and/or adhesive.

In accordance with an embodiment of each of the aspects described herein, the first groove has a first planar portion defined by the first interior surface, the first planar portion facing and being parallel to the first side of the frameless glazed unit. Further, the second groove has a second planar portion defined by the second interior surface, the second planar portion facing and being parallel to the second side of the frameless glazed unit. The first planar portion may be substantially coextensive with an entire width of the first groove, and the second planar portion may be substantially coextensive with an entire width of the second groove.

In accordance with another embodiment of the above aspects, the first interior surface further includes a first flange extending towards the second interior surface and a first pocket interposed between the first flange and the first groove, the first pocket having a greater thickness in a direction transverse to the first side of the frameless glazed unit than the first groove. The second interior surface further includes a second flange extending towards the first interior surface and a second pocket interposed between the second flange and the second groove, the second pocket having a greater thickness in a direction transverse to the second side of the frameless glazed unit than the second groove.

In accordance with still another embodiment of the above aspects, the door further features an additional member extending adjacent to a bottom of the first and second inner openings, the additional member being seated on the first and second flanges and contacting a bottom edge of the frameless glazed unit.

In accordance with a further embodiment of the above aspects, the first and second exterior surfaces respectively include first and second witness lines opposite to the first and second flanges.

In accordance with a still further embodiment of the above aspects, the first and second pockets are arranged and configured to receive excess amounts of the first and second sealants and/or adhesives that overflow from the first and second grooves, respectively.

According to another embodiment of the above aspects, the first and second lips respectively include first and second sealing ribs that respectively contact the first and second sides of the frameless glazed unit and respectively form sides of the first and second grooves.

According to still another embodiment of the above aspects, the first and second door skins each are made of at least a thermoset polymer and fiberglass reinforcement.

A further embodiment of the above aspects involves the frameless glazed unit substantially centered relative to the first and second exterior surfaces.

In still a further embodiment of the above aspects, the frameless glazed unit is a frameless insulated glazed unit (IGU).

Another embodiment of the above aspect involves the door being free of a protuberance, such as a window frame member, that extends outward beyond planes in which the first exterior surface and the second exterior surface principally extend.

In the above aspects, the door skins may be flush door skins or paneled door skins, such as contoured door skins including one or more contoured portions extending inwardly from planes in which the first and second exterior surfaces principally extend. The contoured panels may surround one or more inner panels, which may be coplanar or recessed from the planes in which the first and second exterior surfaces principally extend.

Still another embodiment of the above aspects provides a door that is stackable with an identical additional door, one on another, in stacked relationship in which the first exterior surface of the door is in substantially continuous contact with an additional first exterior surface of the identical additional door over entire respectively surfaces of the first exterior surface and the additional first exterior surface.

Yet another embodiment of the above aspects involves selection of a sealant and/or adhesive that is a structural adhesive.

In the above aspects, at least one of the first and second exterior surfaces may have a molded pattern, such as a molded grain pattern.

The frameless glazed unit of the above aspects may include a plurality of panes, including first and second panes establishing the opposite first and second sides of the glazed unit, and a spacer between the first and second panes. The spacer may extend adjacent each edge of the first and second panes.

The above embodiments may be practiced in any combination with one another.

Other aspects and embodiments of the invention, including apparatus, assemblies, devices, articles, stacked articles, parts and sub-assemblies, methods of making and using, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF THE EXEMPLARY EMBODIMENTS AND EXEMPLARY METHODS

Figure 1:
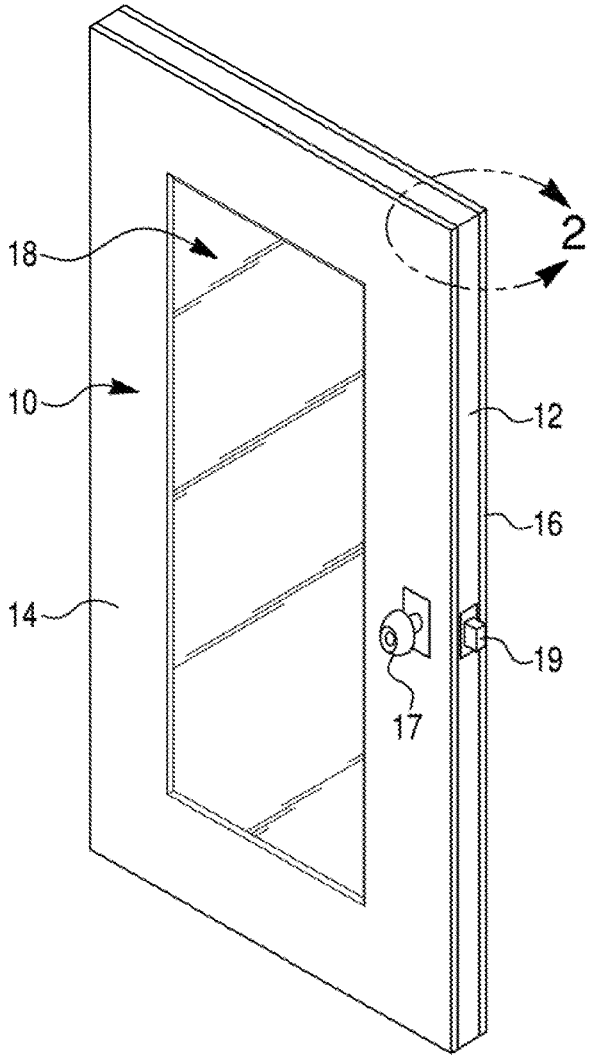
FIG. 1 is a perspective view of a door with a frameless glazed unit according to an embodiment of the invention.

Reference will now be made in detail to the exemplary embodiments and methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and methods.

Figure 2:
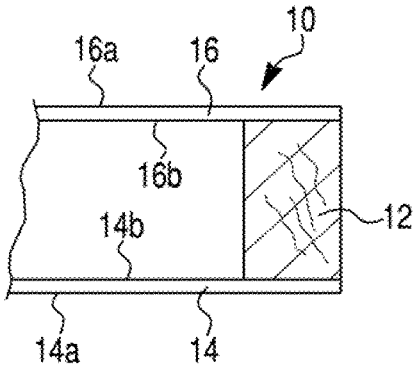
FIG. 2 is an enlarged fragmented view of one corner of the exemplary door of FIG. 1 identified by the circle "II" in FIG. 1.

As best shown in FIGS. 1 and 2, door 10 includes at least a door frame 12, which commonly includes horizontally extending rails at the top and bottom edges of the door 10, and vertically extending first and second stiles respectively at the left and right sides of the door 10. The stiles and rails collectively form the door frame 12. Although not shown, the door frame 12 may further include intermediate stiles and/or rails, lock blocks, or other supports. Door frames of entry doors, such as the door frame 12 of the entry door 10 shown in FIG. 1, are typically configured as rectangles and dimensioned to allow passage of an average size human. For example, the door frame 12 may be about 6.5 to about 8 feet in height and about 2 to about 3.5 feet in width. Secured to opposite first and second sides of the door frame 12 are first and second skins (also referred to as door facings) 14 and 16, respectively. A glazed unit 18 is centered in and secured to the first and second door skins 14 and 16. The door 10 illustrated in FIG. 1 also includes other door components, such as a door knob 17 and latch 19 on one side of the door 10 and hinges (not shown) on the opposite side of the door 10 for pivotally mounting the door 10 to a wall structure or door frame and allowing swinging of the door 10 between open and closed positions. As explained in further detail below, the entry door 10 does not include a window frame for connecting the door skins 14, 16 to the glazed unit 18.

Figure 4:
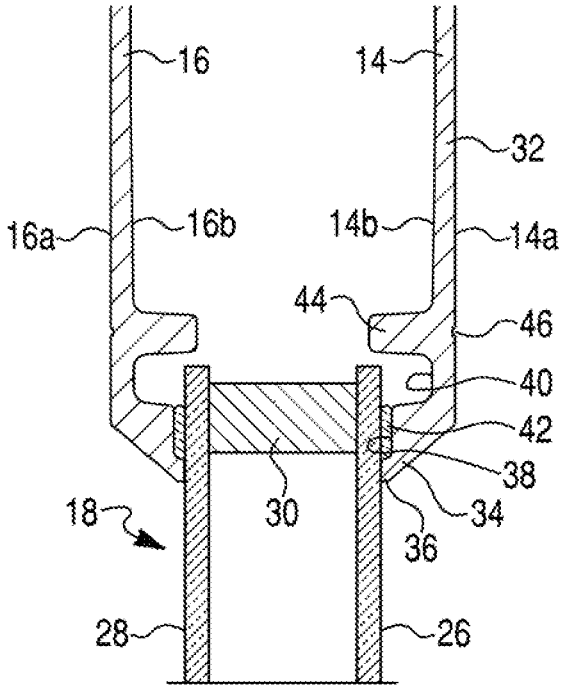
FIG. 4 is an enlarged, fragmented sectional view taken along sectional line IV-IV of FIG. 3.
Figure 5:
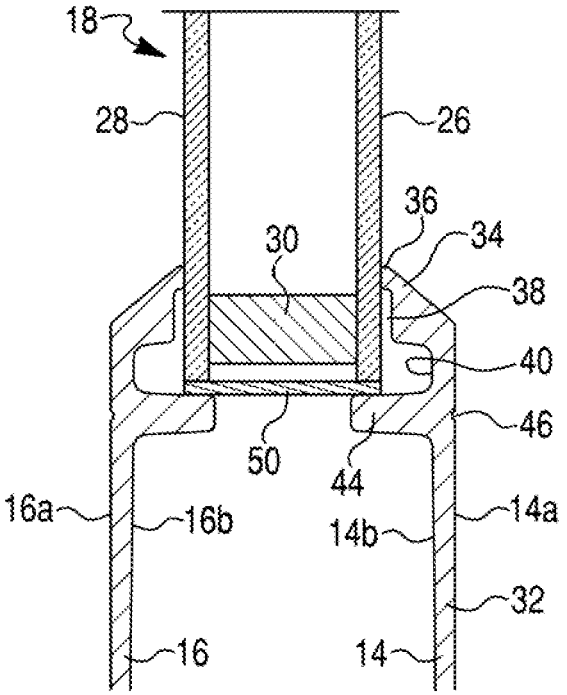
FIG. 5 is an enlarged, fragmented sectional view taken along sectional line V-V of FIG. 3.
Figure 6:
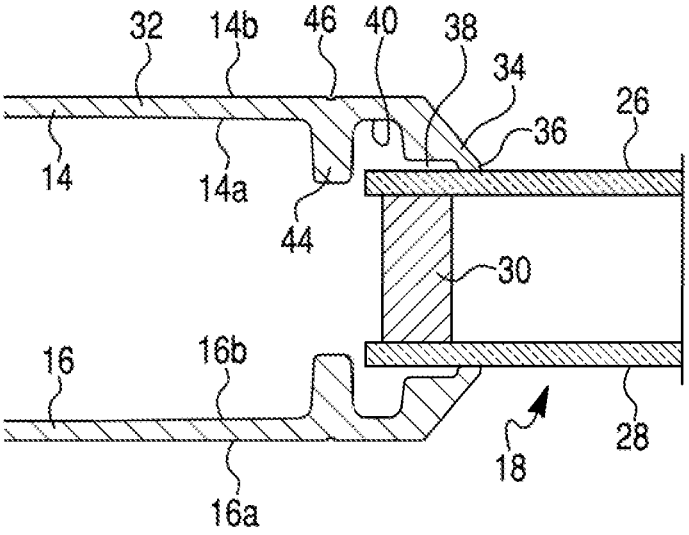
FIG. 6 is an enlarged, fragmented sectional view taken along sectional line VI-VI of FIG. 3.

The glazed unit 18 may include two, three, or more panes 26, 28 secured together by a spacer 30 that separates the panes 26, 28, as best shown in FIGS. 4-6. Alternatively, the glazed unit 18 may include only a single pane. The glazed unit 18 may be an insulated glazed unit or "IGU", in which the space between panes 26, 28, etc. is insulated and may be filled with a gas. Alternatively, a polymer may be included in the space, such as in the case of some safety glass. In the illustrated embodiment of FIG. 1, the glazed unit 18 is a double-pane insulated glazed unit IGU. The panes 26, 28 may be made of, for example, clear sheet glass, tinted glass, and/or textured/patterned glass. Alternatively, the panes can be made of other materials or combinations of materials, including plastics such as acrylics and polycarbonate. For example, in FIGS. 4-6 the door 10 is shown having two panes 26, 28 separated by a spacer 30. Safety glass may also be used. A combination of plastic and glass panels may be used.

Figure 3:
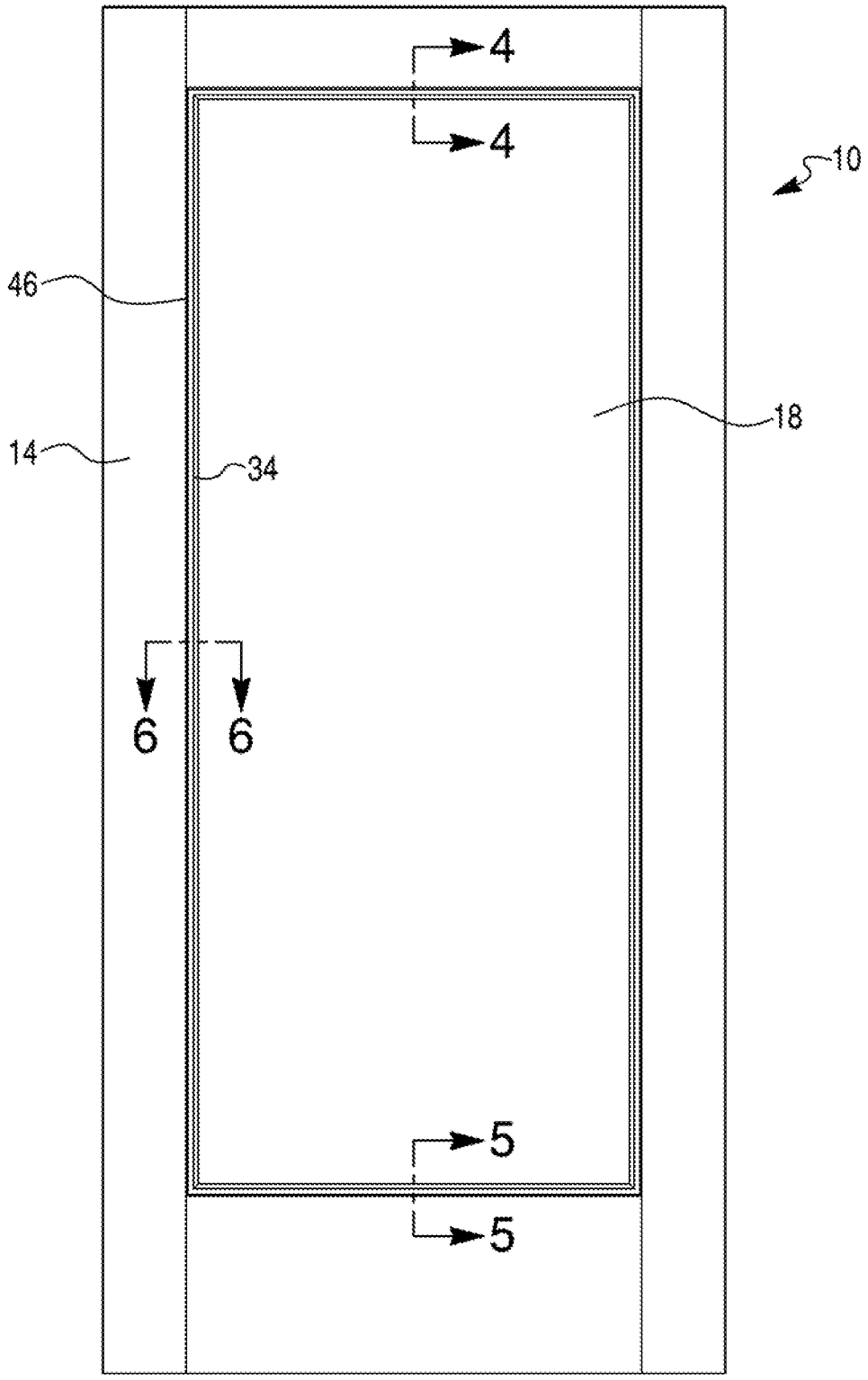
FIG. 3 is a front elevation of the door of FIG. 1.

The glazed unit 18 may have alternative shapes to the rectangular shape shown in FIGS. 1 and 3. For example, the glazed unit 18 may possess other geometries, such as those of a square, a circle, an oval, a triangle, etc. The glazed unit 18 may possess a combination of linear and curved edges, etc. Glazed units and insulated glazed units are commercially available and often sold as pre-assembled products that can be incorporated into the doors embodied and described herein. The glazed unit 18 selected may be configured to withstand impact, e.g., to be hurricane rated. Although only a single glazed unit 18 is shown in the illustrated embodiments, it should be understood that the present invention encompasses embodiments with two, three, four, or more glazed units. For doors having multiple glazed units, the glazed units may be made of the same or different material from one another, and may have the same or different shapes from one another.

The door skins 14 and 16 may be molded from an appropriate polymer material and typically have a thickness of, for example, about 0.13 mm (0.05 inches) to about 52 mm (0.20 inches), depending on the door application in which they are used. The selected material of the door skins 14 and 16 can be a sheet molding compound or "SMC" for short. SMCs typically include, for example, about 15 to about 30 weight percent of the thermosetting resin composition, about 3 to about 20 weight percent low profile additive, about 10 to about 30 weight percent reinforcement, typically fiberglass, and typically other ingredients, such as filler, fire retardants, mold release agents, shelf inhibitors, wetting agents, homogenizers, UV retardants, pigments, thickening agents, antioxidants, antistatic metals, colorants, and/or other additives. Concentrations may be adjusted as warranted for obtaining desired properties. The above composition is provided by way of example, and is not necessarily limiting.

Any suitable molding technique may be employed for the door skins 14 and 16, including, for example, compression molding, resin transfer molding, injection compression molding, thermoforming, etc. Generally, compression molding involves introducing the SMC onto a lower die, then moving one or both dies towards the other to press the SMC under application of heat and pressure in order to compress the SMC so that it conforms to the contour of the die surfaces defining the closed mold cavity. Sheet molding compounds are often pressed within a temperature range of, for example, about 135° C. (275° F.) to about 177° C. (350° F.). The dies exert a pressure on the composition of, for example, about 1000 to about 2000 psi. The pressing operation often lasts, for example, about 30 seconds to 2 minutes. A method for making a door skin is disclosed in U.S. Pat. Pub. No. 2013/0199694. The parameters herein provided are by way of example, and are not necessarily limiting.

Other synthetic materials that may be selected for the door skins 14 and 16 include bulk molding compounds (BMCs), medium density fiberboard, high density fiberboard, and reinforced thermoplastics (e.g., polypropylene, polystyrene). The door skins 14 and 16 may be made of the same or different materials. The exterior surfaces 14*a*, 16*a* of the door skins 14 and 16 are illustrated as flush. Alternatively, the one or both of the exterior surfaces 14*a*, 16*a* may have contoured portions, such as a contoured portion surrounding an inner molded panel. The inner molded panels may be coplanar with or recessed from planes in which the exterior surfaces 14*a*, 16*a* principally extend. The exterior surfaces 14*a*, 16*a* may be smooth or molded to simulate a design or pattern, such as wood grain. The interior surfaces 14*b*, 16*b* of the door skins 14 and 16 may have a relatively rough or textured surface to increase the surface area for adhesion to the door frame 12 and a core, if any. The contour and smoothness/roughness of the exterior surfaces 14*a*, 16*a* and interior surfaces 14*b*, 16*b* may be controlled by selecting mold dies having corresponding cavity-defining surfaces. The core, if present, may be formed in-situ, such as a polymer foam, or may be one or more components inserted during door assembly.

The door skins 14 and 16 are substantially mirror images of one another as shown in FIGS. 4-6. In the interest of brevity, the following discussion will focus on the exterior door skin 14, with the understanding that the interior door skin 16 includes like parts and features. It should be understood that the door skins 14, 16 are not necessarily mirror images.

The illustrated first door skin 14 includes a planar (also referred to as flush) main body portion 32 that extends essentially from the outer perimeter of the door 10 to an inner opening (unnumbered) that receives the glazed unit 18. A lip 34 of the door skin 14 is angled relative to the main body portion 32 and terminates at the inner opening. The lip 34 includes a sealing rib 36 that contacts the pane 26 of the glazed unit 18. While not numbered, FIGS. 4-6 show the second door skin 16 including a similar lip with a sealing rib contacting the pane 28 of the glazed unit 18. The sealing rib 36 forms a side of (and is adjacent to) a groove 38.

The interior surface 14*b* of the lip 34 faces and contacts the pane 26. The interior surface 14*b* includes, concealed from view, the groove 38 that extends all or substantially the length of the pane 26. The portion of the interior surface 14*b* defining the groove 38 is illustrated as planar and extends parallel to the exterior surface of the pane 26 so that the groove 38 has a uniform thickness along most if not its entire width, i.e., the width extends in a vertical direction in FIGS. 4 and 5.

As best shown in FIG. 4, the groove 38 receives sealant and/or adhesive 42. The contact of the sealing rib 36 with the pane 26 of the glazed unit 18 prevents the sealant and/or adhesive 42 from flowing beyond the lip 34 to the exposed area of the pane 26. When cured, the sealant and/or adhesive 42 may act as a dam, for example a foam dam, for preventing moisture, including rain, from penetrating through the interface between the sealing rib 36 of the lip 34 and the pane 26.

Unless otherwise indicated, the sealant and/or adhesive 42 may be a sealant only, an adhesive only, or a combination of a sealant and an adhesive. In the case of a combination of sealant and adhesive, separate sealants and adhesives can be combined, e.g., mixed together. Alternatively, certain compounds, such as structural sealants, can perform both sealant and adhesive functions. A structural sealant with a commercial impact rating is suitable. The sealant may be a moldable compound, such as a paste or foam, or a component such as a gasket or weather strip. The sealant and/or adhesive used for the first door skin 14 (referred to herein as the first sealant and/or adhesive) may be the same as (identical to) or different than the sealant and/or adhesive used for the second door skin 16 (referred to herein as the second sealant and/or adhesive). Typically, the first and second sealants and/or adhesives will be the same.

The interior surface 14*a* forms a pocket or recess 40 adjacent to the groove 38, more specifically on the opposite side of the groove 38 from the sealing rib 36. A flange (also referred to as a rib) 44 extends inward towards a corresponding flange of the opposite door skin 16 to establish an opposite side of the pocket 40 relative to the lip 34. The pocket 40 is positioned and configured to receive an overflow of excess sealant and/or adhesive 42, for example, any sealant and/or adhesive 42 in excess to the amount needed to fill the groove 38. As best shown in FIGS. 4 through 6, the pocket 40 has a greater thickness in a direction transverse to the sides of the frameless glazed unit 18 than the groove 38.

FIGS. 5 and 6 show cross sections at the interfaces of the door skins 14, 16 and the bottom and side, respectively, of the glazed unit 18. The cross sections of FIGS. 5 and 6 are substantially the same as that of FIG. 4. To better show the planar surface of the groove 38, the sealant and/or adhesive 42 has been omitted from the grooves 38 of FIGS. 5 and 6. It should be understood that in practice, the door 10 typically will include the sealant and/or adhesive 42 along the top, bottom, and both sides of the glazed unit 18. The cross section of the right side of the glazed unit 18 is the mirror image of the left side shown in FIG. 6, and hence not shown in the interest of brevity.

FIG. 5 shows an additional member 50 positioned at the bottom of the glazed unit 18 to sit on the flanges 44. The bottom of the glazed unit 18 in turn sits on the additional member 50. The additional member 50 and the flanges 44 may serve as a structural support to bear a substantial part of the weight of the glazed unit 18. The additional member 50 may also or alternatively serve as a dam and/or shock absorber, depending upon the material selected for the additional member 50. Although not shown in the drawings, similar additional members 50 optionally may be placed at the top and/or on either or both sides of the glazed unit 18.

The exterior surface 14*a* of the door skin 14 may be provided with an elongated notch 46 opposite to the flange 44. The notch 46 acts as a witness line to hide the thicker cross section of the door skin 14 at the flange 44, thereby avoiding the appearance of potential picture framing or sink marks. The notch 46 may extend around the entire glazed unit 18.

The glazed unit 18 is frameless inasmuch as there are no external window frame members (such as disclosed in the aforementioned U.S. Pat. Application Pub. No. 2008/0245003) for connecting the door skins 14, 16 to the glass unit 18. Moreover, unlike the window frame member of the '003 published application, which has bulbous door receiving portions 31, 51 and panel support portions 32, 52 with convex exterior surfaces, the door 10 is free of a protuberance(s) or other parts extending outward beyond the respective planes in which the first exterior surface 14*a* and the second exterior surface 16*a* principally extend. Consequently, the door 10 is free of separate window frame members that connect the door skins 14, 16 to the glazed unit 18. The door 10 is stackable with an identical additional door, one on another, in stacked relationship in which the first exterior surface 14*a* of the door 10 is in substantially continuous contact with an additional first exterior surface of the identical additional door over substantially the entire respectively surface areas of the first exterior surface and the additional first exterior surface. It should be understood that inward contours, such as those defining inner panels, of stacked doors will not directly contact one another. The high surface area contact between stacked doors provides a stable stacked structure that is less likely to shift, rock, or be damaged during transport, handling, or storage.

It is understood by those skilled in the art that the door of the present invention can be fabricated in various dimensions to accommodate various sized doors and glazed units therein. Optionally, paint, stain, lacquer, and/or a protective layer may be applied to the exterior surfaces 14*a*, 16*a* of the door skins. The exterior surfaces 14*a*, 16*a* also may have molded or embossed features to provide appearance and feel, such as that of wood grain. U.S. Pat. Nos. 7,367,166, 7,959,817, and 8,246,339, for example, describe molded door skins (also known as door facings) with small grooves configured and arranged to collectively simulate an appearance of a naturally appearing wood grain tick pattern, as well as tonal portions that simulate darkened naturally occurring wood grain background tone. Graphics and patterns may also be printed, such as by ink jet printing, on the exterior surfaces 14*a*, 16*a*.

A kit is also provided for making the door 10. The kit includes the first and second door skins 14, 16 as described above, the door frame 12, and the glazed unit 18 prior to assembly with one another. The kit optionally also includes the sealants and/or adhesives 42.

A method of making the door 10 is also provided. According to one embodiment of the method, the first door skin 14 is connected to a first side of the door frame 12. Adhesive and/or fasteners may be used to connect the door skins 14, 16 to the door frame 12. The first sealant and/or adhesive 42 is applied to the interior surface 14*b* in the groove 38. The frameless glazed unit 18 is situated at the opening of the first door skin 14 so that the pane 26 directly contacts the sealing rib 36 of the lip 34 and the sealant and/or adhesive 42. The sealant and/or adhesive 42, which may be the same as or different than the sealant and/or adhesive 42 applied to the first door skin 14 is applied to the groove of the interior surface 16*b* of the second door skin 16. The second door skin 16 is connected to the door frame 12 and the frameless glazed unit 18 to situate the frameless glazed unit 18 at the second inner opening and contact a second side of the frameless glazed unit 18 with the second lip and the second sealant and/or adhesive. The edges of the door frame 12 and/or the frameless glazed unit 18 may assist in aligning the second door skin 16 with the first door skin 14 and the frameless glazed unit 18. The assembled unit can then be held or stored, optionally under compression, to allow the sealant and/or adhesives to cure, dry, foam, and/or harden. The sealants and/or adhesives 42 and the lips 34 contact and collectively form seals with the panes 26, 28 of the glazed unit 18.

It should be understood that the above-describe exemplary method is provided by way of example. Other methods may be practiced for making the door 10 described herein in its various embodiments. It should be understood that the above exemplary method may be modified to perform certain steps simultaneously or in different sequences. As one example, the first sealant and/or adhesive 42 may be applied to the groove 38 prior to, during, or subsequent to assembling the first door skin 14 with the door frame 12.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

Only those claims which use the words "means for" are to be interpreted under 35 USC 112, sixth paragraph. Moreover, no limitations from the specification are to be read into any claims, unless those limitations are expressly included in the claims.

What is claimed is:

1. A door, comprising:

a door frame having a first side and a second side;

a first door skin having a first rectangular outer periphery and a first inner opening, the first door skin comprising a first exterior surface facing away from the door frame and an opposite first interior surface facing and secured to the first side of the door frame, the first door skin having a first lip integral with the first door skin and situated at the first inner opening;

a second door skin having a second rectangular outer periphery and a second inner opening, the second door skin comprising a second exterior surface facing away from the door frame and an opposite second interior surface facing and secured to the second side of the door frame, the second door skin having a second lip integral with the second door skin and situated at the second inner opening; and a frameless glazed unit situated at the first and second inner openings and comprising first and second panes establishing opposite first and second sides of the frameless glazed unit;

the first door skin providing a first groove containing a first sealant and/or adhesive disposed between the first door skin and the first pane;

the second door skin providing a second groove containing a second sealant and/or adhesive disposed between the second door skin and the second pane, the second sealant and/or adhesive being identical to or different than the first sealant and/or adhesive;

the opposite first and second panes of the frameless glazed unit directly contacting and sealed to the first and second door skins by the first lip and the first sealant and/or adhesive of the first door skin and the second lip and the second sealant and/or adhesive of the second door skin, respectively.

2. The door of claim 1, wherein:

the first groove has a first planar portion defined by the first interior surface, the first planar portion facing and being parallel to the first side of the frameless glazed unit; and the second groove has a second planar portion defined by the second interior surface, the second planar portion facing and being parallel to the second side of the frameless glazed unit.

3. The door of claim 2, wherein the first planar portion is substantially coextensive with an entire width of the first groove, and wherein the second planar portion is substantially coextensive with an entire width of the second groove.

4. The door of claim 1, wherein:

the first interior surface further comprises a first flange extending towards the second interior surface and a first pocket interposed between the first flange and the first groove, the first pocket having a greater thickness in a direction transverse to the first side of the frameless glazed unit than the first groove; and the second interior surface further comprises a second flange extending towards the first interior surface and a second pocket interposed between the second flange and the second groove, the second pocket having a greater thickness in a direction transverse to the second side of the frameless glazed unit than the second groove.

5. The door of claim 4, further comprising an additional member extending adjacent to a bottom of the first and second inner openings, the additional member being seated on the first and second flanges and contacting a bottom edge of the frameless glazed unit.

6. The door of claim 4, wherein the first and second exterior surfaces respectively comprise first and second witness lines opposite to the first and second flanges.

7. The door of claim 4, wherein the first and second pockets are arranged and configured to receive excess amounts of the first and second sealants and/or adhesives that overflow from the first and second grooves, respectively.

8. The door of claim 1, wherein the first and second lips respectively comprise first and second sealing ribs respectively contacting the first and second sides of the frameless glazed unit and respectively forming sides of the first and second grooves.

9. The door of claim 1, wherein the first and second door skins each comprise a thermoset polymer and fiberglass reinforcement.

10. The door of claim 1, wherein the frameless glazed unit is substantially centered relative to the first and second exterior surfaces.

11. The door of claim 1, wherein the frameless glazed unit comprises a frameless insulated glazed unit.

12. The door of claim 1, wherein the door is free of a protuberance that extends outward beyond planes in which the first exterior surface and the second exterior surface principally extend.

13. The door of claim 1, wherein the first and second door skins each include one or more contoured portions extending inwardly from planes in which the first and second exterior surfaces principally extend.

14. The door of claim 13, wherein the door is stackable with an identical additional door, one on another, in stacked relationship in which the first exterior surface of the door is in substantially continuous contact with an additional first exterior surface of the identical additional door over entire respectively surfaces of the first exterior surface and the additional first exterior surface.

15. The door of claim 1, wherein at least one of the first and second exterior surfaces has a molded surface pattern.

16. The door of claim 1, wherein the frameless glazed unit further comprises a spacer between the first and second panes.

17. The door of claim 16, wherein the spacer extends adjacent each edge of the first and second panes.

18. The door of claim 1, wherein the first and second sealants and/or adhesives are structural adhesives.

19. A kit for making a door, the kit comprising:

a door frame having a first side and a second side;

a first door skin having a first rectangular outer periphery and a first inner opening, the first door skin comprising a first exterior surface configured to face away from the door frame and an opposite first interior surface configured to face toward and be secured to the first side of the door frame, the first door skin having a first lip integral with the first door skin and situated at the first inner opening;

a second door skin having a second rectangular outer periphery and a second inner opening, the second door skin comprising a second exterior surface configured to face away from the door frame and an opposite second interior surface configured to face toward and be secured to the second side of the door frame, the second door skin having a second lip integral with the second door skin and situated at the second inner opening; and a frameless glazed unit configured to be situated at first and second inner openings and comprising first and second panes establishing opposite first and second sides of the frameless glazed unit;

the first door skin providing a first groove containing a first sealant and/or adhesive disposed between the first door skin and the first pane;

the second door skin providing a second groove containing a second sealant and/or adhesive disposed between the second door skin and the second pane, the second sealant and/or adhesive being identical to or different than the first sealant and/or adhesive;

the opposite first and second panes of the frameless glazed unit configured to directly contact and be sealed to the first and second door skins by the first lip and the first sealant and/or adhesive of the first door skin and the second lip and the second sealant and/or adhesive of the second door skin, respectively.

20. A method of making a door, comprising:

connecting a first door skin to a first side of a door frame, the first door skin having a first rectangular outer periphery and a first inner opening and comprising a first exterior surface facing away from the door frame and an opposite first interior surface facing and connected to the first side of the door frame, the first door skin having a first lip integral with the first door skin and situated at the first inner opening;

applying a first sealant and/or adhesive to a first groove in the first interior surface;

situating a frameless glazed unit at the first inner opening to contact a first pane of the frameless glazed unit with the first lip and the first sealant and/or adhesive;

providing a second door skin having a second rectangular outer periphery and a second inner opening, the second door skin comprising a second exterior surface and an opposite second interior surface, the second door skin having a second lip integral with the second door skin;

applying a second sealant and/or adhesive to a second groove in the second interior surface, wherein the second sealant and/or adhesive is identical to or different than the first sealant and/or adhesive; and connecting the second interior surface of the second door skin to a second side of the door frame to situate the frameless glazed unit at the second inner opening and contact a second pane of the frameless glazed unit with the second lip and the second sealant and/or adhesive.

* * * * *